US010093014B2

(12) United States Patent
Geiger

(10) Patent No.: US 10,093,014 B2
(45) Date of Patent: Oct. 9, 2018

(54) AUXILIARY HANDLE

(71) Applicant: Hilti Aktiengesellschaft, Schaan (LI)

(72) Inventor: Steffen Geiger, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 15/537,244

(22) PCT Filed: Dec. 15, 2015

(86) PCT No.: PCT/EP2015/079741
§ 371 (c)(1),
(2) Date: Jun. 16, 2017

(87) PCT Pub. No.: WO2016/096819
PCT Pub. Date: Jun. 23, 2016

(65) Prior Publication Data

US 2018/0050447 A1 Feb. 22, 2018

(30) Foreign Application Priority Data

Dec. 19, 2014 (EP) ..... 14199153

(51) Int. Cl.
*A45C 13/26* (2006.01)
*B25F 5/02* (2006.01)
*B25F 5/00* (2006.01)

(52) U.S. Cl.
CPC ..... *B25F 5/026* (2013.01); *B25F 5/006* (2013.01)

(58) Field of Classification Search
CPC ... Y10T 16/469; Y10T 14/4713; A01B 1/026; B25F 5/02; B25F 5/025; B25F 5/026; B25F 5/006; B25B 13/52; B25D 17/04; B25D 17/043; B23B 45/001; B25G 1/002; B25G 1/005; B25G 1/102; B25G 1/10;
(Continued)

(56) References Cited

U.S. PATENT DOCUMENTS 7,823,256 B2 11/2010 Engelfried et al.
2002/0125022 A1* 9/2002 Dieterle ..... B25F 5/026 173/170
(Continued)

FOREIGN PATENT DOCUMENTS

DE 10 2006 055 524 A1 5/2008
EP 1 400 317 A1 3/2004
EP 2 163 357 A1 3/2010

OTHER PUBLICATIONS

PCT/EP2015/079741, International Search Report issued dated Mar. 14, 2016, with partial English translation (Five (5) pages).

*Primary Examiner* — Chuck Y Mah
(74) *Attorney, Agent, or Firm* — Crowell & Moring LLP

(57) ABSTRACT

An auxiliary handle is disclosed. The auxiliary handle has a frame-shaped grip which has a grip bar for gripping by a user, a crossbar, and two flanks connecting the grip bar to the crossbar. A loop-shaped clamping element is fastened to the crossbar for placing on a neck of a handheld machine tool. A clamping mechanism serves for clamping the element about the neck of the handheld machine tool. The frame-shaped grip has a frame-shaped base body molded from a first plastic, which has a solid body joint in each of the regions of the flanks. A casing made from a second plastic encloses the fame-shaped base body in the region of the grip bar and the solid body joints.

9 Claims, 2 Drawing Sheets

(58) Field of Classification Search
CPC ... B25G 3/00; B25G 3/02; B25G 3/18; B25G 3/20; B25G 3/24; B25G 3/26; B25G 3/28; B25G 3/30
See application file for complete search history.

(56) References Cited

U.S. PATENT DOCUMENTS

| | | | | |
|---|---|---|---|---|
| 2009/0000434 | A1* | 1/2009 | Shinma | B25D 17/04 81/491 |
| 2009/0307875 | A1* | 12/2009 | Nakashima | B25F 5/006 16/436 |
| 2010/0064480 | A1* | 3/2010 | Martin | B25F 5/026 16/426 |
| 2010/0064482 | A1* | 3/2010 | Martin | B25F 5/026 16/426 |
| 2010/0206596 | A1* | 8/2010 | Kamegai | B23D 51/01 173/162.2 |
| 2012/0312572 | A1* | 12/2012 | Nemetz | B25D 17/043 173/162.2 |
| 2013/0047802 | A1* | 2/2013 | Vierck | A01D 34/416 81/489 |
| 2015/0266176 | A1* | 9/2015 | Takeuchi | B25D 11/00 173/117 |

* cited by examiner

AUXILIARY HANDLE

This application claims the priority of International Application No. PCT/EP2015/079741, filed Dec. 15, 2015, and European Patent Document No. 14199153.9, filed Dec. 19, 2014, the disclosures of which are expressly incorporated by reference herein.

BACKGROUND AND SUMMARY OF THE INVENTION

The present invention relates to a frame- or bracket-shaped auxiliary handle for a handheld machine tool, in particular a chiseling handheld machine tool.

Frame-shaped auxiliary handles are used on heavy, powerful, chiseling handheld machine tools. Users can guide and lift the handheld machine tool by means of the auxiliary handle. U.S. Pat. No. 7,823,256 discloses an auxiliary handle having a frame-shaped grip. A clip may enclose a neck of a hammer drill. A clamping lever tightens the clip to secure the auxiliary handle to the neck.

Vibrations of the handheld machine tool are transmitted to the auxiliary handle. The auxiliary handle is intended to dampen the vibrations in addition to having good control characteristics.

The auxiliary handle, according to the invention, has a frame-shaped handle which has a grip bar for gripping by a user, a crossbar and two flanks connecting the grip bar to the crossbar. Fastened to the crossbar is a loop-shaped clamping element for attaching to a neck of the handheld machine tool. A clamping mechanism serves to clamp the clamping element around the neck of the handheld machine tool. The frame-shaped handle has a frame-shaped base body of a first injection-molded plastic, the body having a solid body joint in the region of each of the flanks. A casing made of a second plastic surrounds the frame-shaped base body in the region of the grip bar and the flanks.

The two solid body joints support the grip bar against undesired tipping movements and still allow a damping along the most highly loaded direction, namely the work axis of the handheld machine tool.

The solid body joints may be formed by a constriction of the base body along a direction perpendicular to a plane stretched from the grip bar and the crossbar. The constriction is preferably perpendicular to a plane stretched from the frame-shaped grip. A dimension of the base body perpendicular to a plane stretched from the grip bar and the crossbar in the region of the solid body joint may be 10 to 25% of the dimension of the base body perpendicular to the plane in the region of the grip bar. The stiffness of the grip bar is correspondingly several times greater along the direction.

The solid body joints may be designed in a wavy manner to obtain a damping during a movement of the grip bar in a direction toward the grip bar.

The auxiliary handle may be characterized in that the solid body joints are fully filled with the first plastic and the second plastic in a plane perpendicular to the pivot axis, wherein a proportion of the first plastic lies between 10% and 20%. In the pivot direction, the solid body joint consists preferably primarily of a softer plastic. The grip may have in the region of the solid body joints a circular or elliptical cross-section with a maximum difference between the large semi-axis to the smaller semi-axis of 10%, wherein the cross-section is completely filled by the base body and the second synthetic material.

The following description explains the invention by means of illustrative embodiments and drawings.

DETAILED DESCRIPTION OF THE DRAWINGS

Figure 1:
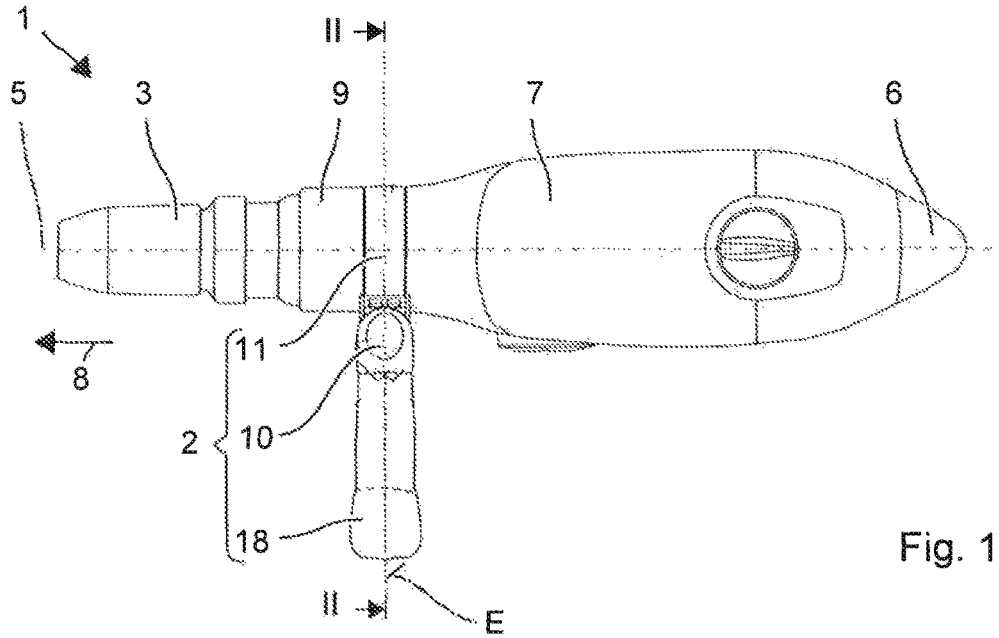
FIG. 1 illustrates a hammer drill with an auxiliary handle.

Identical or functionally identical elements are indicated using the same reference signs in the drawings, unless noted otherwise.

FIG. 1 schematically depicts a hammer drill 1 as an example of a handheld machine tool, to which is attached an auxiliary handle 2. Hammer drill 1 has a tool holder 3 in which, for example, a drill bit 4 or another tool can be received on a work axis 5. A primary handle 6 is at least partially arranged on a work axis 5. Primary handle 6 is permanently attached to a side, facing away from tool holder 3, of a machine housing 7. The user can guide hammer drill 1 by pressing handle 6 in work direction 8. If needed, auxiliary handle 2 can be attached to machine housing 7. Machine housing 7 preferably has adjoining to tool holder 3 a cylindrical section, hereinafter referred to as neck 9.

Illustrative auxiliary handle 2 can be attached to and detached again from neck 9 of hammer drill 1 without using tools. Illustrative auxiliary handle 2 has a loop- or ring-shaped clamping element 10, e.g., an elastic clamping band 11 or a rigid clip. Clamping element 11 has an axis 12, which is essentially perpendicular to clamping element 11 and runs through its center. When attaching auxiliary handle 2 to handheld machine tool 1, axis 12 comes into contact with work axis 5 of handheld machine tool 1. A clamping mechanism 10 shortens the circumference of clamping element 11, by means of which auxiliary handle 2 is secured to neck 9. Illustrative clamping mechanism 10 along with an anchor bar 13 pulls together open ends 14 of clamping band 11. The user can operate the anchor bar with a clamping lever 15. A screw spring 16 can compensate tolerances in the circumference of the neck and thereby different clamping forces.

Auxiliary handle 2 has a frame-shaped grip 17. A longitudinal side of grip 17 forms a grip bar 18 designed for gripping. Grip rod 18 is essentially cylindrical. The diameter and length of grip bar 18 are configured in regard to the ergonomic requirements of a gripping hand. A one-piece or a two-piece crossbar 19 forms a longitudinal side, opposite grip bar 18, of grip 17.

Clamping element 11 is attached to crossbar 19, preferably in the center of crossbar 19. Grip bar 18 and crossbar 19 may be parallel to each other or as depicted, their longitudinal axes 20, 21 may be inclined at an angle of up to 20 degrees, e.g., at least 5 degrees. Grip bar 18 and crossbar 19 lie in plane E (cross-sectional plane II-II), which is stretched from their longitudinal axes 21. Plane E lies perpendicular to axis 12 or, if clamping element 11 can be tilted relative to hand grip 6 about crossbar 19, tilted by at least 45 degrees. Plane E is correspondingly perpendicular to work axis 5 or tilted by at least 45 degrees to the work axis of hammer drill 1, respectively.

Grip bar 18 and crossbar 19 are connected to the frame by means of two essentially cylindrical flanks 22. Flanks 22 are preferably parallel to each other. Flanks 22 of frame-shaped grip 17 contain two solid body joints 23. Solid body joints 23 connect grip bar 18 to crossbar 19 along connection axes 24. Solid body joints 23 are preferably parallel to each other. Solid body joints 23 allow a springiness of grip bar 18 about a pivot axis 25 running through both solid body joints 23. Pivot axis 25 is preferably parallel to crossbar 19 and lies in plane E. When subjected to a load perpendicular to plane E, grip bar 18 may be deflected elastically about pivot axis 25.

Figure 4:
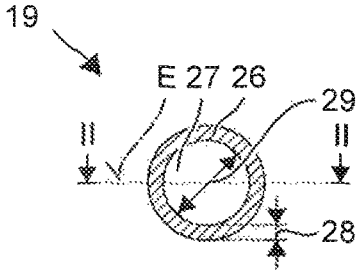
FIG. 4 is a cross-section through the grip bar in plane IV-IV.
Figure 5:
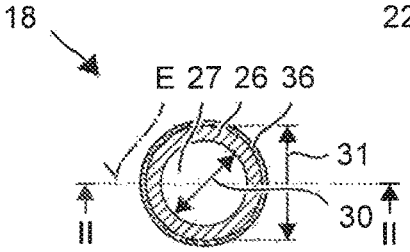
FIG. 5 is a cross-section through the crossbar in plane V-V.

Frame-shaped grip 17 has a monolithic, contiguous base body 26, which forms grip bar 18, crossbar 19 and both solid body joints 23. Base body 26 is preferably injection-molded out of a rigid plastic. The plastic is polyamide for example. Base body 26 is hollow in the region of crossbar 19 (FIG. 4). Clamping mechanism 10 may be arranged in hollow space 27 of crossbar 19. A wall thickness 28 of base body 26 preferably lies in a range of 2 mm to 5 mm. Diameter 29 of hollow space 27 may be larger than wall thickness 28. Preferably, diameter 29 is at least five times, advantageously up to 10 times, greater than wall thickness 28. Hollow space 27 extends preferably also to the angled ends of crossbar 19, which solid body joints 23 contact. Grip bar 18 is also hollow (FIG. 5). Hollow space 27 extends over the entire length of grip bar 18 and preferably over the curved ends of grip bar 18 all the way to solid body joints 23. For grip bar 18, wall thickness 28 can be selected to be the same for crossbar 19. Diameter 30 of hollow space 27 or grip bar 18 respectively can vary over their length in regard to ergonomic factors of a gripping hand. Exterior diameter 31 is preferably in a range between 25 mm and 40 mm.

Solid body joints 23 are formed by base body 26. Base body 26 is solid in the region of solid body joint 23 and has a significantly smaller thickness 32 compared to exterior diameter 31 of crossbar 19 and grip bar 18. Solid body joint 23 may be referred to as flat. Thickness 32 is determined in direction 33 perpendicular to frame-shaped grip 17, i.e., plane E. Thickness 32 is approximately equal to wall thickness 28 in the region of crossbar 19 or grip bar 18. Thickness 32 is thus in a range of 10% to 25% of exterior diameter 31 of grip bar 18.

Solid body joints 23 can be designed in a wavy manner. The wave shapes are parallel to pivot axis 25. Solid body joint 23 rises and falls along connection axis 24 perpendicular to plane E. The length of solid body joint 23 is designed to be greater than distance 34 between grip bar 18 and crossbar 19. Solid body joint 23 can compress along connection axis 24.

Solid body joints 23 are designed to be rigid along pivot axis 25. Width 35, i.e., the dimension along pivot axis 25, of solid body joints 23 is approximately equal to exterior diameter 31 of grip bar 18. Solid body joints 23 thus essentially lie level to plane E. Width 35 and the distance of the two solid body joints 23 to each other along pivot axis 25 ensure high torsional stiffness. The distance is largely equal to the length of grip bar 18.

Grip bar 18 is covered with a thin layer 36 of a soft plastic. The soft plastic is rubber or synthetic caoutchouc for example. The soft plastic has no load-bearing function, but improves the haptic feel. A friction value of the soft plastic for skin and textiles is preferably higher than the friction value of the hard plastic for skin and textiles to prevent a hand from sliding on the grip bar 18. The plastic may have a vibration-damping effect. Soft layer 36 has a small thickness, e.g., ranging between 0.5 mm and 2 mm.

Figure 3:
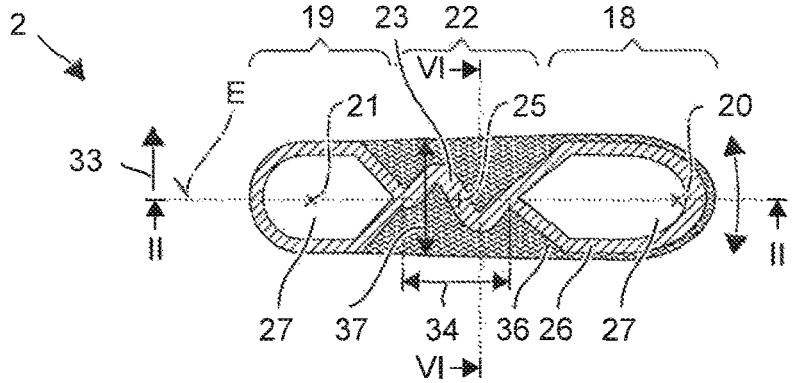
FIG. 3 is a cross-section through the auxiliary handle in plane III-III.

Grip 17 has on flanks 22, i.e., in the region of solid body joint 23, a similar cross-section as in the range of grip bar 18. Exterior dimensions 37 of flanks 22, also in vertical direction 33, are approximately equal to the associated exterior dimensions of grip bar 18 and crossbar 19. In regard to the illustrative grip 17, grip bar 18 has a somewhat greater exterior diameter 31 compared to crossbar 19. Exterior dimension 37 of flank 22 lies, depending on the value, between the two exterior diameters 31 (cf. FIG. 3). Base body 26 is encapsulated with the soft plastic in the region of solid body joint 23. The soft plastic is applied with thickness 38, which compensates for the difference of flat base body 26 to the dimensions in region of grip bar 18. Thickness 38, the dimension perpendicular to plane E, of casing 36 is substantially larger than thickness 32 of base body 26.

Figure 6:
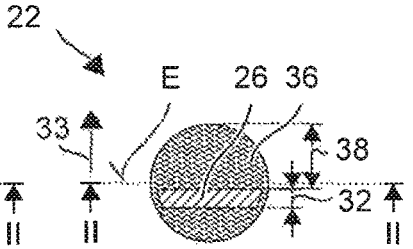
FIG. 6 is a cross-section through the flank with the solid body joint in plane VI-VI.

Preferably, the cross-section through grip 17 in the region of solid body joint 23 (FIG. 6) has approximately the same dimensions as grip bar 18. The cross-section is circular or elliptical for example, wherein the larger semi-axis differs by less than 20% from the smaller semi-axis. The cross-section of solid body joint 23 is completely filled with the plastics, in contrast to the hollow grip bar 18.

Figure 7:
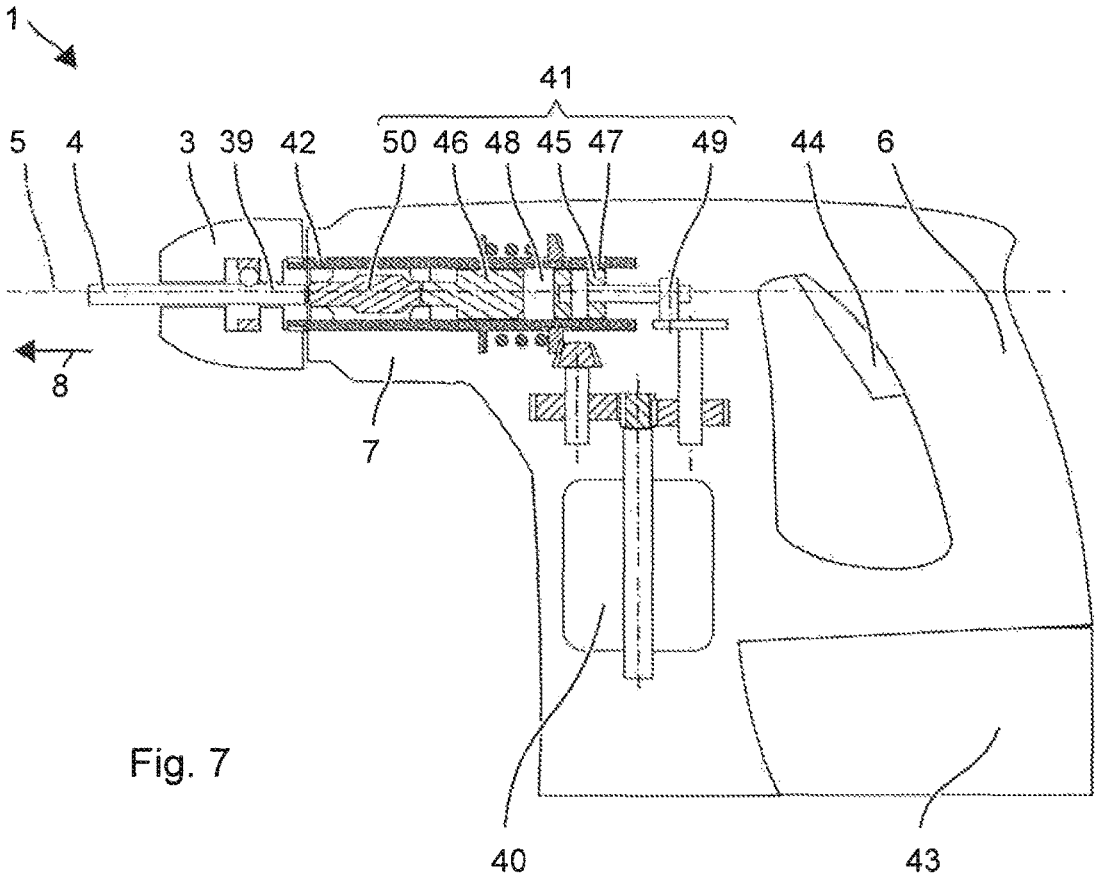
FIG. 7 illustrates the hammer drill.
Figure 2:
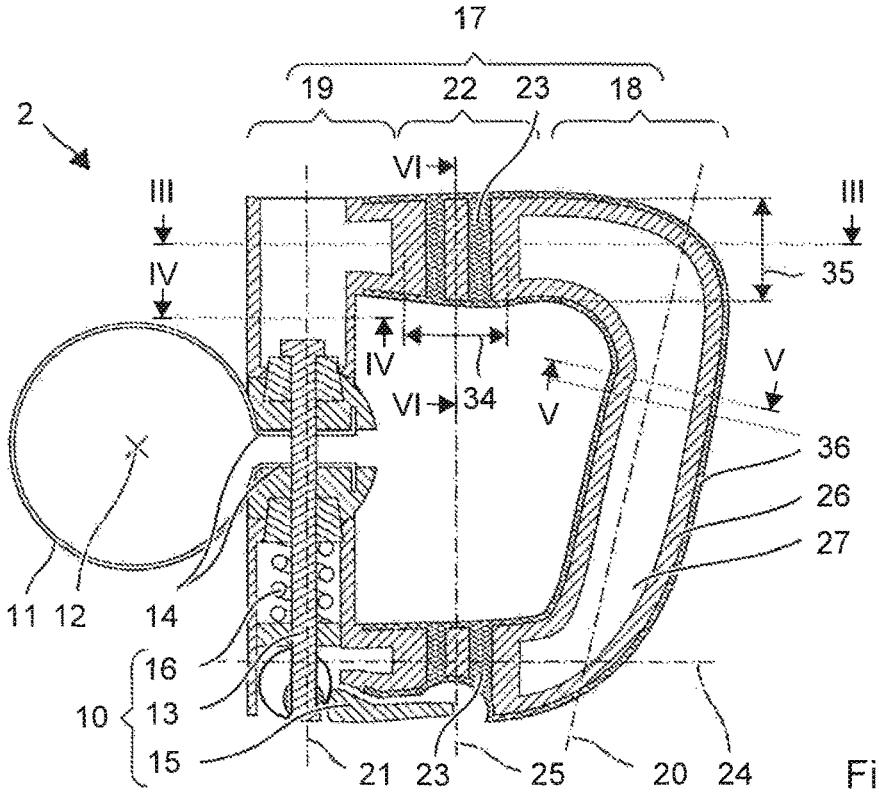
FIG. 2 is a longitudinal cross-section through the auxiliary handle in plane II-II.

FIG. 7 schematically depicts the structure of illustrative hammer drill 1. Hammer drill 1 has a tool holder 3, in which a shank end 39 of a tool, e.g., one of drill bit 4, can be inserted. Forming a primary drive of hammer drill 1, a motor 40 drives a percussion mechanism 41 and a drive shaft 42. A battery pack 43 or a power cable supplies motor 40 with electricity. Pneumatic percussion mechanism 41 and preferably the other drive components are arranged within a machine housing 7. A user can guide hammer drill 1 by means of a handle 6, which is attached to machine housing 7. Motor 40 and thus hammer drill 1 can be placed into operation by means of system switch 44. When operating, hammer drill 1 continually turns drill bit 4 about a work axis 5 and can thereby strike drill bit 4 in strike direction 8 along work axis 5 into a substrate.

Pneumatic percussion mechanism 41 has an exciter 45 and a striking element 46, which are movably guided in a guide sleeve 47 along work axis 5. Exciter 45 and striking element 46 enclose between them a pneumatic chamber 48. Exciter 45 is periodically moved back and forth by motor 40 on work axis 5. A cam 49 can for example convert the rotational motion of motor 40 into the linear motion of exciter 45. Pneumatic chamber 48 forms a pneumatic spring, which connects striking element 46 to the motion of exciter 45. In striking direction 8, striking element 46 strikes a plunger 50 or, in a direct manner, a drill bit 4.

The invention claimed is:

1. An auxiliary handle for a handheld machine tool, comprising:

a frame-shaped grip which has a grip bar for gripping by a user, a crossbar, and two flanks connecting the grip bar to the crossbar; and a clamping element attached to the crossbar;

wherein the frame-shaped grip has a frame-shaped base body injection-molded of a first plastic and wherein the frame-shaped base body has respective solid body joints in regions of the two flanks;

wherein a casing of a second plastic surrounds the frame-shaped base body in a region of the grip bar and the solid body joints.

2. The auxiliary handle according to claim 1, wherein the solid body joints are completely surrounded by the casing.

3. The auxiliary handle according to claim 1, wherein the grip bar is pivotable in relation to the crossbar about a pivot axis which runs through the solid body joints.

4. The auxiliary handle according to claim 3, wherein the solid body joints are rigid along the pivot axis.

5. The auxiliary handle according to claim 3, wherein the solid body joints, in a plane perpendicular to the pivot axis, is filled completely with the first plastic and the second plastic and wherein a proportion of the first plastic is between 10% and 20%.

6. The auxiliary handle according to claim 1, wherein the solid body joints are formed by a constriction of the frame-shaped base body along a direction perpendicular to a plane stretched from the grip bar and the crossbar.

7. The auxiliary handle according to claim 1, wherein a dimension of the frame-shaped base body perpendicular to a plane stretched from the grip bar and the crossbar in a region of the solid body joints is between 10% and 25% of a dimension of the frame-shaped base body perpendicular to the plane in a region of the grip bar.

8. The auxiliary handle according to claim 1, wherein the solid body joints are wavy.

9. The auxiliary handle according to claim 1, wherein the frame-shaped grip in a region of the solid body joints has a circular or elliptical cross-section with a maximum difference of a large semi-axis to a smaller semi-axis of 10%, wherein the cross-section is completely filled by the frame-shaped base body and the second plastic.

* * * * *